US011376759B2

(12) United States Patent
Thuemler

(10) Patent No.: US 11,376,759 B2
(45) Date of Patent: Jul. 5, 2022

(54) VARIABLE OPENING REDUCER FOR LOGS AND STEMS

(71) Applicant: BID GROUP TECHNOLOGIES LTD., Prince George (CA)

(72) Inventor: Nick Thuemler, Corning, CA (US)

(73) Assignee: BID GROUP TECHNOLOGIES LTD., Prince George (CA)

( * ) Notice: Subject to any disclaimer, the term of this patent is extended or adjusted under 35 U.S.C. 154(b) by 159 days.

(21) Appl. No.: 16/513,020

(22) Filed: Jul. 16, 2019

(65) Prior Publication Data

US 2020/0016786 A1 Jan. 16, 2020

Related U.S. Application Data

(60) Provisional application No. 62/698,462, filed on Jul. 16, 2018.

(51) Int. Cl.

| | |
|---|---|
| ***B27L 1/10*** | (2006.01) |
| *B27B 31/06* | (2006.01) |
| *B27B 31/08* | (2006.01) |
| *B27B 31/00* | (2006.01) |

(52) U.S. Cl.

CPC ..... *B27L 1/10* (2013.01); *B27B 31/003* (2013.01); *B27B 31/06* (2013.01); *B27B 31/08* (2013.01)

(58) Field of Classification Search

CPC .... B27B 5/00; B27B 5/02; B27B 5/04; B27B 5/08; B27B 5/12; B27B 5/22; B27B 33/20; B27L 1/10; B27C 1/005; B27C 1/007; B27C 1/08; B27C 1/06

See application file for complete search history.

(56) References Cited

U.S. PATENT DOCUMENTS

| | | | | |
|---|---|---|---|---|
| 4,441,536 A * | 4/1984 | Rautio | B23Q 7/18 | 144/181 |
| 4,549,586 A * | 10/1985 | Klocker | B27B 5/12 | 144/116 |
| 5,447,186 A * | 9/1995 | Achard | B27B 1/007 | 144/116 |
| 5,722,475 A | 3/1998 | Lammi | | |
| 6,705,363 B2 * | 3/2004 | McGehee | B27B 1/007 | 144/245.2 |

(Continued)

*Primary Examiner* — Matthew Katcoff

(74) *Attorney, Agent, or Firm* — Brouillette Legal Inc.; Robert Brouillette

(57) ABSTRACT

A Variable Opening Reducer (VOR) for chipping excess fibers on a piece of wood periphery is described, the VOR comprising an infeed portion for securing and moving the piece of wood, along a longitudinal log axis thereof, inside the VOR, a chipping portion disposed sequentially after the infeed portion for receiving therein the piece of wood and for chipping and removing peripheral sections of the piece of wood, the chipping portion comprising a plurality of cutting tools, each of the cutting tools being adapted to revolve about a rotation axis thereof that is substantially perpendicularly located in respect of the longitudinal log axis of the log, each of the cutting tools being radially located in a position interfering with the piece of wood periphery to chip and remove excess fibers and an outfeed portion, disposed after the chipping portion, for receiving, securing and moving the piece of wood along the longitudinal log axis thereof A kit and a method of use thereof are also presented in the present application.

22 Claims, 5 Drawing Sheets

(56) References Cited

U.S. PATENT DOCUMENTS

| | | | | |
|---|---|---|---|---|
| 2003/0226617 | A1 | 12/2003 | Choquette | |
| 2009/0173411 | A1* | 7/2009 | Trost | B27C 5/00 144/392 |
| 2011/0079324 | A1* | 4/2011 | Appeldoorn | B27B 5/04 144/376 |
| 2016/0031116 | A1 | 2/2016 | Cholewczynski | |

* cited by examiner

VARIABLE OPENING REDUCER FOR LOGS AND STEMS

CROSS-REFERENCE TO RELATED APPLICATIONS

The present patent application claims the benefits of priority of U.S. Provisional Patent Application No. 62/698,462, entitled "Variable Opening Reducer for Logs/Stems", and filed at the United States Patent and Trademark Office on Jul. 16, 2018, the content of which is incorporated herein by reference.

FIELD OF THE INVENTION

The present invention generally relates to a variable opening reducer for a debarking machine adapted to remove excess fibers on a log. More particularly, the present invention relates to a variable opening machine to reduce the flare butt of a log or a stem.

BACKGROUND OF THE INVENTION

Trees that are cut to produce lumbers and other wood pieces are collected from the woods. Generally, a tree is getting wider at its base where roots are emerging from the trunk and getting in the ground. Some other portions of the tree might also be wider than the general diameter of the trunk.

The variable opening reducer for logs and stems is a machine designed to remove excess portions from the log that form anomalies undesirable to log positioning and processing. The variable opening reducer is a machine that generally runs in line with the main log line at a sawmill. Usually the reducer would be placed right before a debarker machine but does not have to be located at this precise location. Conventionally, various reducers were designed to remove excessive fibers on a wood log with tools revolving around a longitudinal log axis of the wood log. The tools are revolving around the wood log in addition to their own cutting rotation to cut off any portions of fibers around the log that are exceeding a general sensed diameter of the wood log. These reducer apparatuses are complex given the required revolving motion that needs to be done around the wood log in addition to managing the rotating cutting tools.

There are also apparatuses and systems for removing excessive fibers around a wood log that are using replaceable tool-supporting rings to accommodate different wood log diameters. These apparatuses are configured to use cutting tools fixedly secured to the tool-supporting ring and need to be adjusted manually on the tool-supporting ring to match a desired diameter for accommodating the wood log that needs to be trimmed. Such adjustments must be done when the apparatus is not in operation, hence increasing the down time of the apparatus. The downside to all of the machines that do not adjust on the fly, is that you are limited to wood logs within the dimension the cutting tools are set to. One would have to batch run and sort the wood logs through the machine to effectively remove the flare based on the actual diameter of the wood log. One of the downsides of the variable adjustable ring machine type as disclosed by US 2016/0031116, is that it is a very complex system and you have no opportunity to remove material from only one side, or just the top or bottom of the wood log. There are also offline machines that spin the logs at a fixed relationship to the wood log diameters. This requires a lot of space in the mills, remove the unwanted material and then re-enter the wood log into the process line.

Another type of apparatuses uses a tool-supporting ring of different diameters with cutting tools secured thereto that are not rotating around the wood log to process the wood log over its entire periphery; the wood log is rotating about its longitudinal log axis against the cutting tools in such apparatuses while the cutting tools are remaining at a fixed distance from the longitudinal log axis of the wood log. However, this system can remove only material at the end of the wood log, or the stem, since a mechanism needs to secure the wood log at the other end to make it rotate in the process. Yet, some systems use rollers which are rotating along an axis parallel to the longitudinal axis of the log. Cutting tools allows removing parts of the logs at specific location along the longitudinal axis of the logs. The rollers drive the rotation of the logs.

It is believed needs exist for improvements in wood log reducer apparatus, including wood log reducer apparatuses, to ensure the log are rounded or at least reduced to optimize other downstream operation on the work line such as chipping, cutting and/or planning. They is also needs for log reducer apparatus aiming at limiting the maintenance time and down time of the downstream machines executing operations on the rounded log in order to maximize production and to manage a wide range of wood log diameters without having to change or adjust cutting tools therein. One or more such needs are believed to be met by one or more embodiments of the present invention.

SUMMARY OF THE INVENTION

The present invention includes many aspects and features.

According to at least one other aspect of the invention, in accordance with at least one embodiment thereof, is provided as infeed portion, a chipping portion and an outfeed portion arranged in series thereof for managing, positioning and moving a wood log for trimming and removing excess fibers from the wood log.

Accordingly, in aspects of the present invention, an improved variable opening reducer for wood log and stems is provided. The variable opening reducer uses four separately positioned chipping hourglass shaped cutting tools configured to match an exterior contour of the wood log. Each of these four cutting tools is independently adjustable by an actuator where the exterior hourglass "concave" shape of the cutting tools is adapted to contour a portion of the wood logs. The logs are scanned by either a 3d scanner or could be by photo eyes, laser sensing or other comparable means. The 3d scanner allows to investigate the exterior shape of the log and be a support to decide which parts of the log are undesirable and must be removed. Using this information, the chipping heads is managed to be positioned to whatever position required to remove the unwanted materials. One, some, or all of the heads of the cutting tool heads can be repositioned accordingly to the scanned log. When placed in front of a debarking machine, the variable opening reducer can be used to make sure no logs can jam in the debarking machine. Anything over a maximum predetermined diameter will be removed from the log, saving downtime and preventing machinery damage.

According to at least another aspect of the invention, in accordance with at least one embodiment thereof, is provided a variable opening reducer for logs and stems that is using a plurality of pairs of cutting tools to reduce logs and stems without rotating the log about its longitudinal log axis.

According to at least one other aspect of the invention, in accordance with at least one embodiment thereof, is provided a variable opening reducer for logs and stems that is including a plurality of pairs of cutting tools to reduce logs and stems without rotating the log, wherein each of the pairs of cutting tools are configured to radially move to adjust a distance between each of the pair of cutting tools to process logs of various diameters without changing a size of the cutting tools.

According to at least one aspect of the invention, in accordance with at least one embodiment thereof, is provided a variable opening reducer for logs and stems that is using cutting tools adapted to rotate about respective cutting tool axes that are generally perpendicular to an axial direction of the log.

According to at least one aspect of the invention, in accordance with at least one embodiment thereof, is provided a variable opening reducer for logs and stems that is using plurality of cutting tools that are shaped with a concave portion therein for adapting to a curved exterior shape of a wood log.

According to at least one aspect of the invention, in accordance with at least one embodiment thereof, is provided a variable opening reducer for logs and stems that is using plurality of cutting tools that are shaped with a concave portion therein for adapting to a curved exterior shape of a wood log, wherein the combination of all cutting tools are adapted to cut an entire periphery of the wood log in a single passage.

According to at least one aspect of the invention, in accordance with at least one embodiment thereof, is provided a variable opening reducer for logs and stems that is using at least one pair of cutting tools that are shaped with a concave portion therein for adapting to a curved exterior shape of a wood log, wherein the position of the pair of cutting tools are managed to radially locate the cutting tools in respect with a sensed signal of a shape of the periphery of the wood log.

According to at least one aspect of the invention, in accordance with at least one embodiment thereof, is provided a variable opening reducer for logs and stems that is using at least one pair of cutting tools that are shaped with a V shaped or a U shaped section and adapted to rotate about a rotation axis that is non-parallel with a longitudinal log axis of the wood log. The distance between each of the cutting tools being managed on a basis of a sensed signal reflecting an exterior periphery of a wood log to trim and shred portions of the wood log that are identified to be trimmed and reduced.

In addition to the aforementioned aspects and features of the present invention, it should be noted that the present invention further encompasses the various logical combinations and subcombinations of such aspects and features. Thus, for example, claims in this or a divisional or continuing patent application or applications may be separately directed to any aspect, feature, or embodiment disclosed herein, or combination thereof, without requiring any other aspect, feature, or embodiment.

In yet another aspect of the invention, a variable opening reducer (VOR) for chipping excess fibers on a piece of wood periphery is provided. The VOR comprises an infeed portion for moving the piece of wood, along a longitudinal log axis thereof toward the VOR, a reducing portion disposed sequentially after the infeed portion for receiving therein the piece of wood and for removing peripheral sections of the piece of wood, the reducing portion comprising a plurality of cutting tools, each of the cutting tools being adapted to revolve about a rotation axis thereof that is substantially perpendicularly located in respect of the longitudinal log axis of the log, each of the cutting tools being radially located in a position interfering with the piece of wood periphery to remove excess fibers. The VOR further comprises an outfeed portion, disposed after the chipping portion, for receiving, securing and moving the piece of wood along the longitudinal log axis thereof.

The piece of wood may be axially movable through the VOR while remaining substantially fixed in respect with an angular rotation about the longitudinal log axis. The cutting tools may comprise a plurality of teeth thereon.

The revolving cutting tools may comprise a concave portion adapted to contour a portion of the piece of wood periphery or may comprise a plurality of sequentially positioned heads, each head being shape to provide a portion of a concave portion adapted to contour a portion of the piece of wood periphery. The cutting tools may further be radially movable about the longitudinal log axis.

The VOR may further comprise a sensor for reading/identifying a shape of the piece of wood. The sensor may be adapted to read the shape of the piece of wood to identify the outside sections of the piece of wood that are distally extending a predetermined diameter to be chipped. The sensor may be sequentially located before the reducing portion. The sensor may be a 3D scanner.

The infeed portion may be longitudinally aligning the piece of wood with a central portion of the reducing portion. The reducing portion may comprise a pair of cutting tools.

The pair of cutting tools may be arranged in a pair of opposed cutting tools. Thee pair of opposed cutting tools may be radially movable about the longitudinal log axis.

The infeed portion and the outfeed portion may comprise a first pair of opposed centering rolls. The infeed portion and outfeed portion further comprise a second pair of opposed centering rolls perpendicularly positioned with the first pair of opposed centering rolls.

Each cutting portion may comprise opposed frustoconical cutting portions forming a recessed portion therebetween. The revolving rotation axis may be at angle ranging from 80 to 110 degrees in respect of the longitudinal log axis of the log.

In another aspect of the invention, a method for reducing excess fibers on a piece of wood periphery is provided. The method comprises determining a baseline diameter of the piece of wood, positioning a plurality of rotating cutting tools to form a passageway along a longitudinal log axis thereof, the passageway having a diameter about equal to the baseline diameter and being about perpendicular to the longitudinal log axis, moving the piece of wood in the passageway along the longitudinal log axis and reducing any excess fibers in peripheral portions of the piece of wood having a diameter greater or equal to the baseline diameter.

The determination of the baseline diameter may further comprise scanning the piece of wood. The piece of wood periphery may comprise a flared butt, the baseline diameter being determined as being the diameter of the piece of wood adjacent to the flared butt.

The method may further comprise identifying the extremity at which the flared but is found on the piece of wood.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

Figure 1:
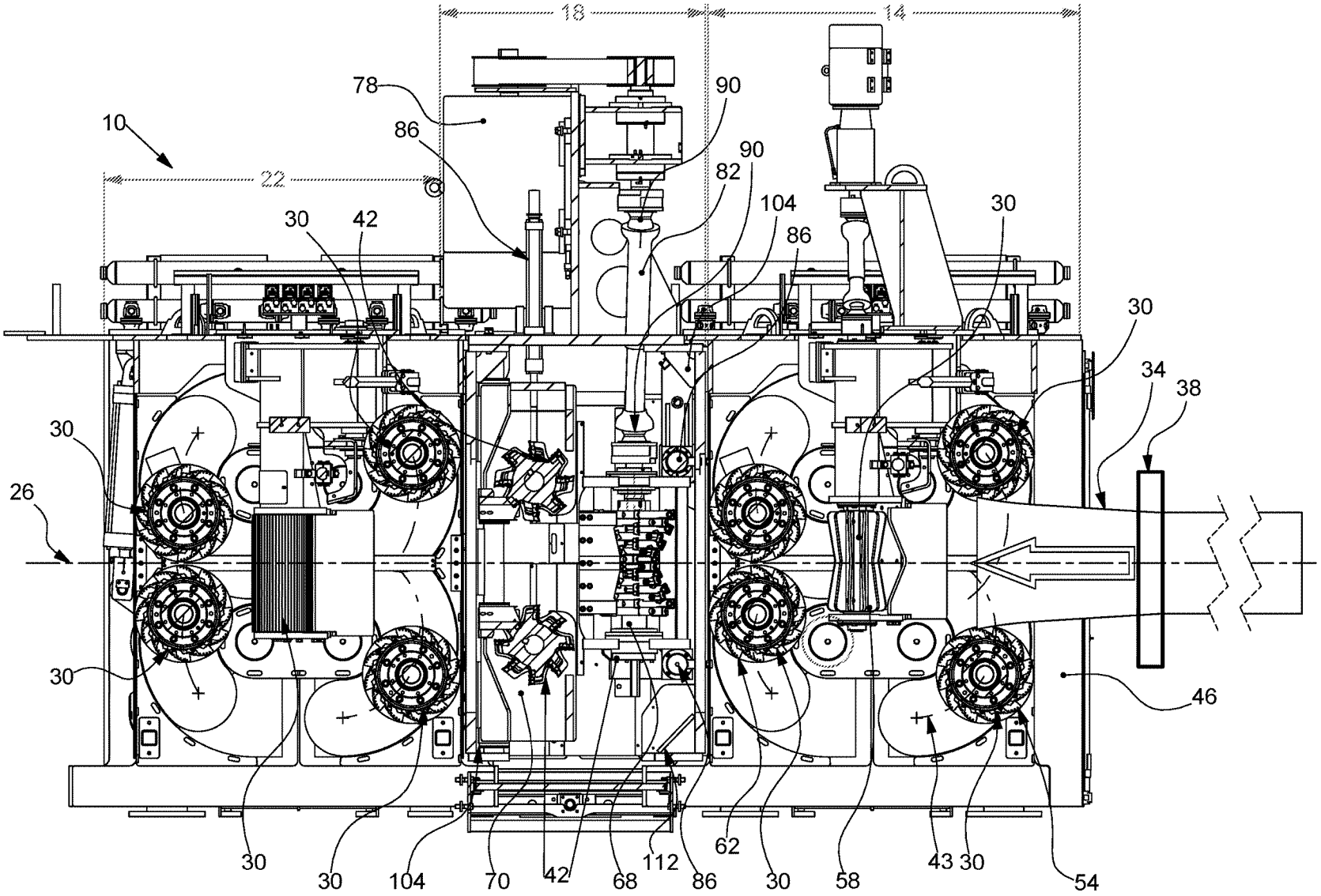
FIG. 1 is a lateral elevational side view of a variable opening reducer for wood logs, in accordance with at least one embodiment thereof.

A novel variable opening reducer for logs and stems will be described hereinafter. Although the invention is described in terms of specific illustrative embodiments, it is to be understood that the embodiments described herein are by way of example only and that the scope of the invention is not intended to be limited thereby.

As a preliminary matter, it will readily be understood by one having ordinary skill in the relevant art ("Ordinary Artisan") that the invention has broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention disclosed herein; only one or a plurality of the features disclosed herein; or combination thereof. As such, many embodiments are implicitly disclosed herein and fall within the scope of what is regarded as the invention.

Accordingly, while the invention is described herein in detail in relation to one or more embodiments, it is to be understood that this disclosure is illustrative and exemplary of the invention, and is made merely for the purposes of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. It is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once during performance of the claimed method.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." When used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

The detailed disclosure herein refers to the concept of chipping. In the present disclosure, chipping refers to the operation of removing chunks from a log as opposed to shredding which refers to reducing or cut into very small strips or reducing to shreds. In the present disclosure, chipping may also refer to grinding, which means rubbing or wearing an external surface of the wood log, to cutting and/or to reducing, Referring to the drawings, one or more preferred embodiments of the invention are next described. The following description of one or more preferred embodiments is merely exemplary in nature and is in no way intended to limit the invention, its implementations, or uses. Hence, a novel variable opening reducer for logs/stems will be described herein after.

Figure 2:
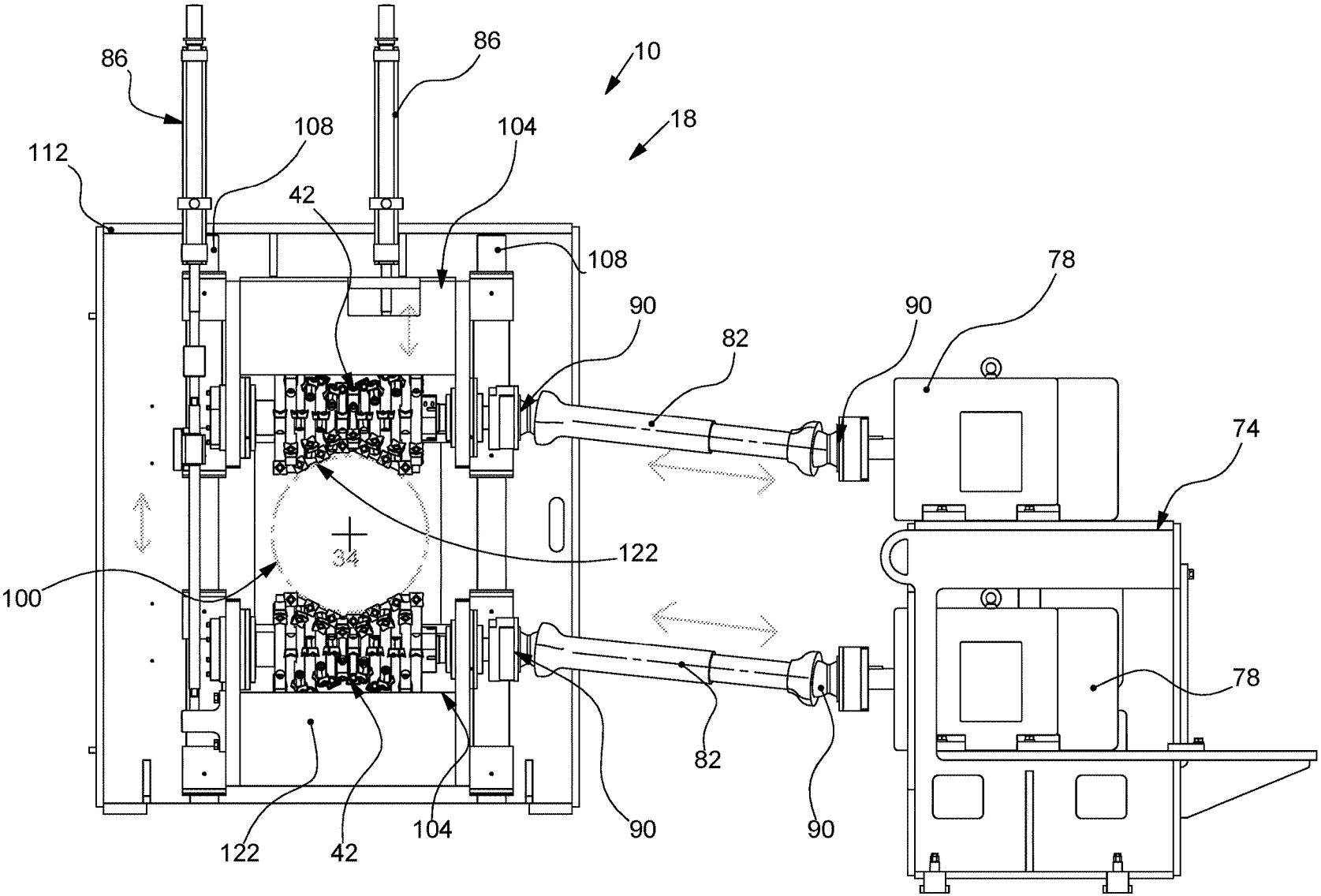
FIG. 2 is a front elevational view of the variable opening reducer of FIG. 1 showing two horizontally disposed chipping head, in accordance with at least one embodiment thereof.

Referring to FIG. 1 and FIG. 2, a preferred embodiment of a Variable Opening Reducer 10, hereinafter referred to VOR, is illustrated. In typical embodiments, the VOR 10 comprises an infeed portion 14, a chipping portion 18 and an outfeed portion 22. The infeed portion 14, the chipping portion 18 and the outfeed portion 22 are all aligned along a longitudinal log axis 26.

The infeed portion 14 generally comprises a plurality of centering rolls 30 adapted to receive, feed and locate a log 34 entered in the infeed portion 14. Understandably, any type of log feeding system may be used to move logs toward the chipping portion 18, such as conveyors, rollers or other conveying system.

In some embodiments, the log 34 is first introduced in a scanner 38 detecting different parameters of the log 34, such as sensing periphery of the log 34 to manage the centering rolls 30 and the cutting tools 42 operatively disposed in the VOR 10 for trimming the excess fibers around the log 34. The centering rolls 30 may be shaped as cylinders or hourglass shape, with fluted traction aids to allow the log 34 to slide to a centered position in the horizontal plane of the VOR 10.

Generally, the log 34 will be scanned by either a 3D scanner or could be scanned by photo eyes or other comparable means. The signal from the scanner 38 is material to determine, individually or collectively, a transversal position for each cutting tool 42.

In some embodiments, the log 34 may be scanned along its entire length. The data captured by the scanner may be communicated to a computer program or a controller configured to identify the general shape of the log and to determine at which extremity of the log is located the flare butt. The controller further determines the required width between the cutting tools 42 to allow reducing the flare butt. Upon determining the extremity comprising the flare butt, the controller commands the movement of the cutting tool 42 to be positioned at the predetermined width prior to the extremity comprising the flare butt passes through the cutting tools 42.

In some embodiments, the plurality of centering rolls 30 are working in opposed pairs in respective transversal (vertical) plans to properly apply pressure on the log 34 for moving the log 34 in the VOR 10 in a desirable direction and a proper angle. Each pair of centering rolls 30 are driven by a single or a plurality of motors (not illustrated) and are also pivotably assembled in the infeed portion 14 along a pivot path 43 between a narrow position and a wide position adapted to manage a wood log with a large diameter. The illustrated embodiment is using a first pair 54 of centering rolls 30 acting vertically, a second pair 58 of centering rolls 30 acting horizontally and a third pair 62 of centering rolls 30 acting vertically as well. These three pairs 54, 58, 62 of centering rolls 30 in the infeed portion 14 are actuated collectively to position and properly align the log 34 for the chipping operation.

In yet other embodiments, an impair number of centering rolls 30 could be used to guide and position the log 34 prior to being reduced. As an example, three rollers 30 generally positioned as a triangle could be used to align and position the log 34.

The chipping portion 18 of the VOR 10 is where actual chipping of the log 34 is performed. The chipping portion 18 is provided with two pairs of opposed rotating cutting tools 42. Each cutting tool 42 is operatively connected to a motor 78 via a drive portion 82, the motor 78 being secured to a support 74. The cutting tools 42 are also assembled in the chipping portion 18 with a mechanism adapted to vary or manage a distance between each of the cutting tools 42 to chip and reduce a diameter of the log 34 to a calculated predetermined diameter.

In the shown embodiment, a first pair 68 of cutting tools 42 is cutting the lateral sides of the log 34 whereas a second pair 70 of cutting tools 42 is cutting the upper and lower sides of the log 34. The distance between each of the cutting tools 42, from a pair of cutting tools 68, 70 in the chipping portion 18, is actuated with a plurality of actuators 86. The cutting tools 42 are disposed in the chipping portion 18 with a rotation axis that is generally perpendicular to the log axis 26 and the cutting tools 42. The cutting tools 42 may be rotated either in a direction against the movement of the log 34 or in a same direction as the movement of the log, where the wood log 34 is fed against the cutting tools 42. It is contemplated within the scope of this description that at least two cooperating cutting tools 42 properly shaped with a recessed portion 122 deep enough in their central portion 126 are rotating to cut a periphery of the wood log 34 when the wood log 34 is axially moved toward the cutting tools 42.

In other embodiments, the VOR 10 could work with three cutting tools 42 although their 120-degree arrangement might be challenging to drive and operate. A VOR 10 with four cutting tools 42 is illustrated as a preferred embodiment because of, inter alia, its two pairs symmetry and cutting tool axes parallelism in addition to require cutting tools 42 of concave portions of limited depth and overall size. In yet other embodiments, any other number of cutting tools 42 could be used to chip the log 34, such as having five (5) cutting tools assembled as a pentagon or six (6) cutting tools assembled as a hexagon.

One can appreciate the drive portion 82 driving the cutting tools 42 is equipped with a pair of universal joints 90 to allow movement of the cutting tools 42 in a desired cutting position to set a log working diameter 100 adapted to the sensed outside contour of the wood log 34 to be trimmed. Each pair of cutting tools 42 is operatively supported by a carriage 104 slidably secured to a plurality of linear rails 108 to allow transversal displacements of the cutting tools 42 to a desired radial position to accommodate the dimensions of the scanned log 34. Understandably, any other mechanism or means adapted to move the cutting tools toward each another or away from one another could be used within the scope of the present invention.

Figure 3:
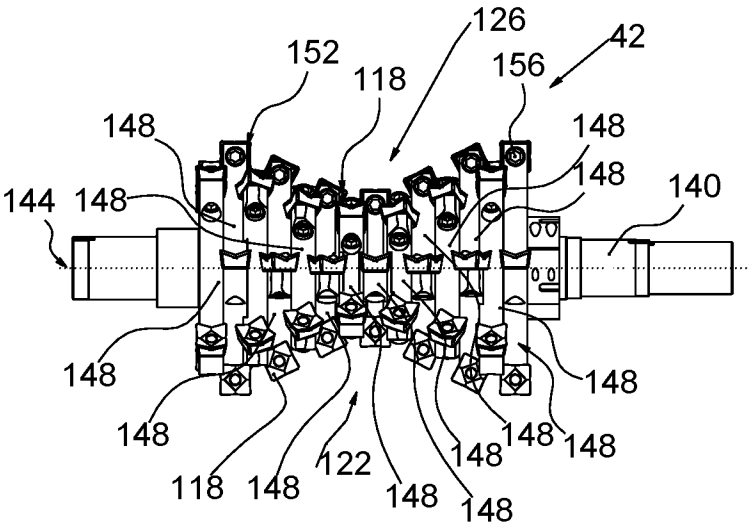
FIG. 3(A) is a perspective view of an embodiment of chipping tool of the variable opening reducer of FIG. 2, in accordance with at least one embodiment thereof.
FIG. 3(B) is a front elevational view of a chipping tool of the variable opening reducer of FIG. 2, in accordance with at least one embodiment thereof.
Figure 3:
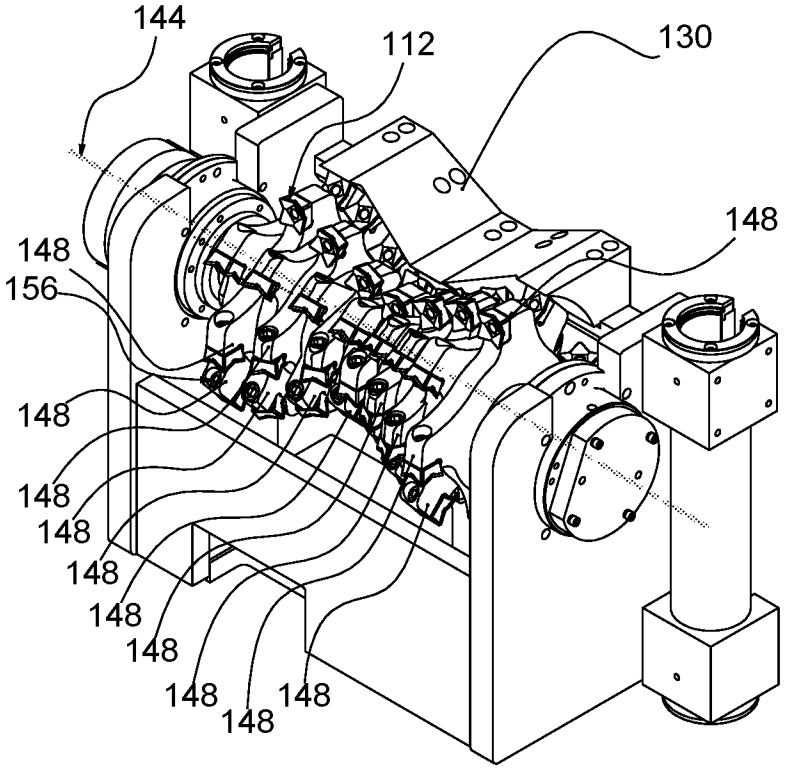

Referring now to FIG. 1, a preferred embodiment with four shaped cutting tools 42 mounted in pairs is shown, respectively the vertical upstream pair and the horizontal downstream pair, to completely work the contour the log 34 in one passage of the log 34 in the VOR 10. Each cutting tool 42 comprises an optionally shaped anvil 130 (see FIG. 3(A)) to stabilize the log 34 after it is chipped by the cutting tools 42 and also to direct the wood chips produced by the chipping operation toward a suitable exit to be collected. As best seen in FIGS. 3(A) and 3(B), the shape of the cutting tips 118, such as but not limited to a carbide tooth, is adapted to cut and chip the contour of the log 34 according to the cutting tips 118 layout on the cutting tools 42. Each of the cutting tool 42 is generally rotatably secured to a support shaft 140 adapted to rotate about a rotation axis 144 thereof. The cutting tool 42 may comprise a series of radially extending tooth supports 148 having a collective profile shaping the recessed portion 122 to create a substantially round or another cutting shape. The tips 118 are angled in accordance with the desired end shape resulting from the chipping of the log 34. In another embodiment, the tips 118 may be positioned at a similar angle but be offset to form a generally concave or recessed shape to accommodate the periphery of the log. Each of the tooth supports 148 is adapted to secure thereon one or many cutting tips 118 on a tip-receiver portion 152 held in place with a fastener 156. It can be appreciated the cutting tips 118 are alternated and somehow interfering with each other to achieve the desired cut with the plurality of cutting tips 118 in a compact arrangement thereof. All parts are assembled on the shaft 140 while the components can alternatively be welded together or be shaped in as a shaft 140 (not illustrated) designed to include means for cutting with a cutting shape embedded in the shaft 140.

Figure 4B:
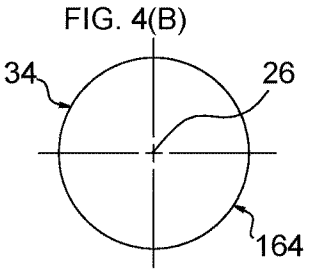
FIG. 4(B) is a front elevational view of a wood log to be processed with the variable opening reducer, in accordance with at least one embodiment thereof.
Figure 5B:
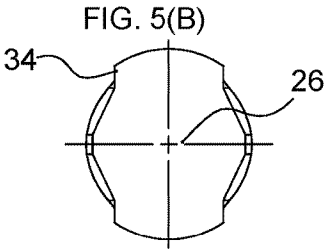
FIG. 5(B) is a front elevational view of a wood log that begins to be processed with the variable opening reducer, in accordance with at least one embodiment thereof.
Figure 6B:
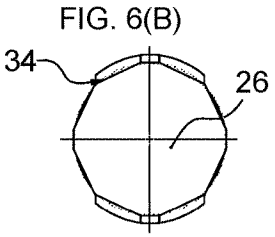
FIG. 6(B) is a front elevational view of a wood log that is further processed with the variable opening reducer, in accordance with at least one embodiment, in accordance with at least one embodiment thereof.
Figure 7B:
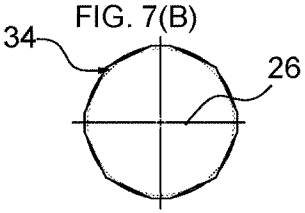
FIG. 7(B) is a front elevational view of a wood log that is processed with the variable opening reducer, in accordance with at least one embodiment thereof.
Figure 4A:
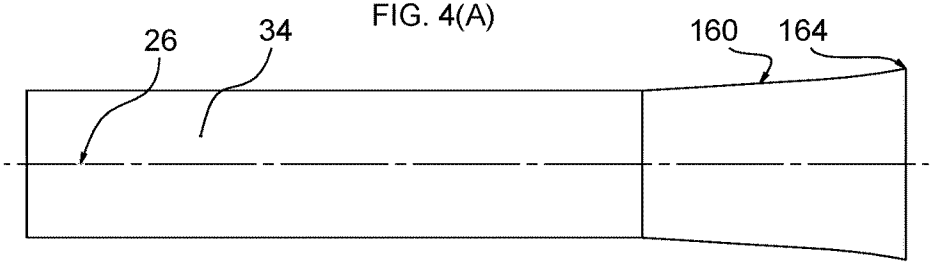
FIG. 4(A) is a side elevational view of a wood log to be processed with the variable opening reducer, in accordance with at least one embodiment thereof.
Figure 5A:
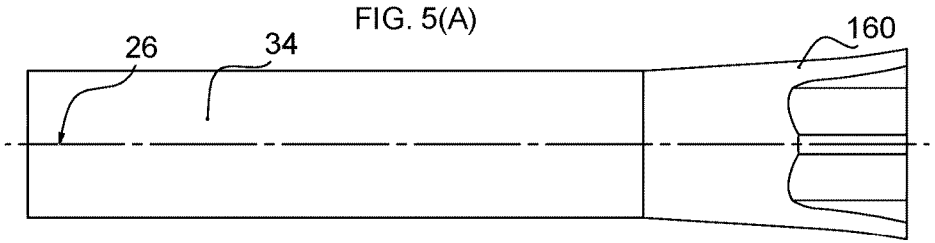
FIG. 5(A) is a side elevational view of a wood log that begins to be processed with the variable opening reducer, in accordance with at least one embodiment thereof.
Figure 6A:
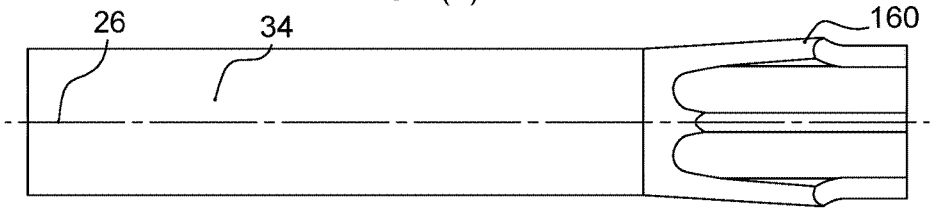
FIG. 6(A) is a side elevational view of a wood log that is further processed with the variable opening reducer, in accordance with at least one embodiment thereof.
Figure 7A:
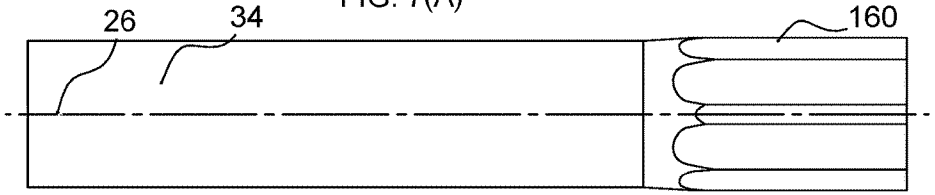
FIG. 7(A) is a side elevational view of a wood log that is processed with the variable opening reducer, in accordance with at least one embodiment thereof.

A typical wood log 34 is illustrated in FIG. 4(A) throughout FIG. 7(B) in various chipping stages. FIG. 4(A) and FIG. 4(B) are illustrating a log 34 with a wider portion 160 from a natural flare butt 164 before being chipped with the VOR 10. FIG. 5(A) and FIG. 5(B) are illustrating the log 34 of FIG. 4(A) with the wider portion 160 beginning being chipped in a first transformation with the VOR 10 when it is cut by the first pair 68 of lateral cutting tools 42 chipping the log 34 to remove excess material on each side of the log 34. FIG. 6(A) and FIG. 6(B) are illustrating the log 34 of FIG. 5(A) with the wider portion 160 beginning being chipped with the VOR 10 with a second transformation using both the first pair 68 of lateral cutting tools 42 and the second pair 70 of cutting tools 42 chipping the log 34. FIG. 7(A) and FIG. 7(B) are illustrating the log 34 of FIG. 6(A) with the wider portion 160 being chipped with the VOR 10 with both the first pair 68 of cutting tools 42 and the second pair 70 of cutting tools 42 chipping the log 34, hence having reduced the wider portion 160 of the log 34. When the log 34 has passed completely through the VOR 10, the wider portion flare butt 160 of the log 34 is completely removed. If the diameter of the log 34 is too big, the VOR 10 can reduce the diameter of the log 34 to the desired diameter. One can appreciate the final shape represents the external shape of the cutting tools 42 and is consequently not perfectly round. Other shapes reflecting alternative other cutting tool shapes are encompassed by the present description.

Figure 9:
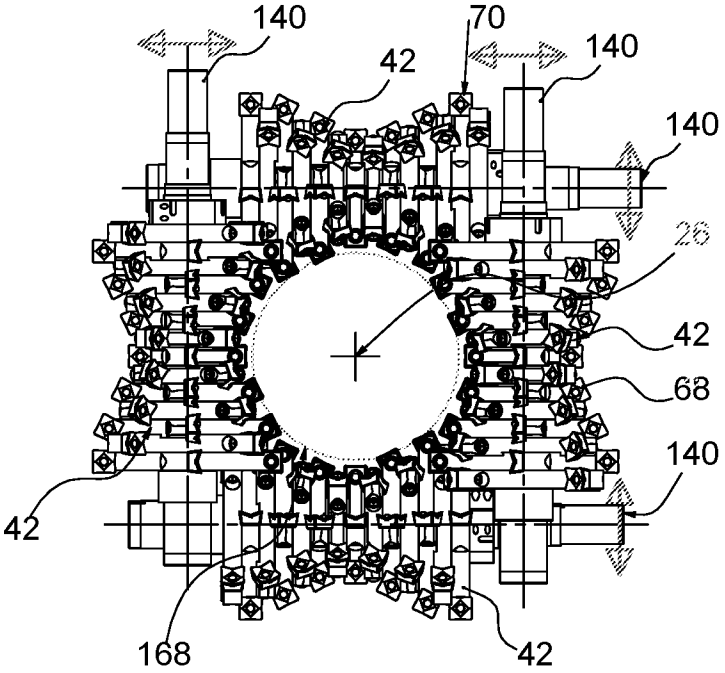
FIG. 9 is a front elevational view of an arrangement of cutting tools with the variable opening reducer, in accordance with at least one embodiment thereof.
Figure 8:
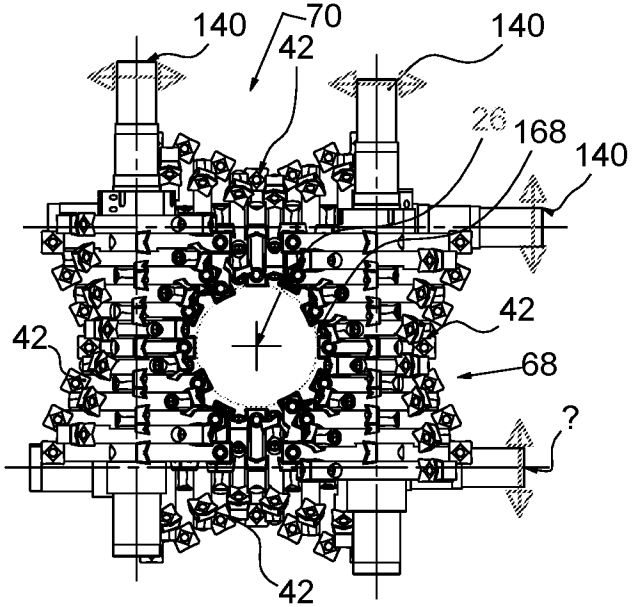
FIG. 8 is a front elevational view of an arrangement of cutting tools with the variable opening reducer, in accordance with at least one embodiment thereof.

FIGS. 8 and 9 are illustrating the two pairs 68, 70 of cutting tools 42 in isolation to better appreciate their operations to set a desired diameter to chip the log 34 according to the data provide by the sensor 38. The two pairs 68, 70 of cutting tools 42 are proximally closer in FIG. 8 to set a cutting diameter 168 of, illustratively, about 30 centimeters (12 inches). The two pairs 68, 70 of cutting tools 42 are proximally further in FIG. 9 to set a cutting diameter 168 of, illustratively, about 30 centimeters (20 inches). This change in cutting diameter 168 opening is made by managing the distances between each of the cutting tools 42 of each of the pairs 68, 70.

Still referring to FIGS. 8 and 9, each cutting tool 42 may have a general hourglass shape or at least a central portion being thinner than the extremity to provide a peripheral shape of the log. When rotatably mounted, all cutting tool 42 forms a central enclosure or passage for the log 34. The diameter of the enclosure or passage is determined by the general average diameter of the log 34 to be conserved. As an example, if the scanner identifies that an extremity of the log 34 has a diameter of 40 inches while has an average diameter of 34 inches, the cutting tools 42 are positioned to form a general passage having a diameter of about 34 inches and thus shall chip any portion of the log 34 having a diameter of more than 34 inches.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A Variable Opening Reducer (VOR) for chipping excess fibers on a log or stem periphery, the VOR comprising:

a flared butt detector configured to:
- characterize a flared butt on the log or stem; and
- calculate a baseline diameter based on the characterized flared butt; a reducing portion comprising:
- linear guiding elements;
- a plurality of movable chipping tools, each of the chipping tools:
  - revolving about a rotation axis substantially perpendicular to a longitudinal axis of the log or stem, the rotation axis being at an angle with at least one other rotation axis of another chipping tool, and
  - chipping peripheral sections in excess of the calculated baseline diameter of the log or stem;
- a plurality of actuators operatively connected to the chipping tools, the actuators displacing the chipping tools along the guiding elements forming to form a substantially circular processing passageway prior to receiving the log, the passageway having a diameter substantially equal to the calculated baseline diameter of the log or stem, the reducing portion being adapted to remove peripheral sections in excess of the calculated baseline diameter of the log or stem, wherein two of the plurality of chipping tools are displaced by the actuators along the same displacement axis;

infeed portion for moving the log or stem toward the reducing portion along the longitudinal axis of the log or stem; and an outfeed portion for moving the log or stem away from the reducing portion.

2. The VOR for chipping excess fibers of claim 1, wherein the log or stem is axially movable through the VOR while remaining substantially fixed in respect with an angular rotation about the longitudinal axis of the log or stem.

3. The VOR for chipping excess fibers of claim 1, wherein each of the chipping tools comprises a plurality of teeth thereon.

4. The VOR for chipping excess fibers of claim 1, wherein the chipping tools comprise a concave portion adapted to form a portion of the processing passageway.

5. The VOR for chipping excess fibers of claim 4, wherein each of the chipping tools comprises a plurality of heads sequentially positioned along the rotation axis of said chipping tool, each head comprising a plurality of knives forming the concave portion.

6. The VOR for chipping excess fibers of claim 1, wherein the actuators are configured to move the chipping tools radially about the longitudinal axis of the log or stem.

7. The VOR for chipping excess fibers of claim 1, wherein the flared butt detector further comprises a sensor for measuring the baseline diameter of the log or stem.

8. The VOR for chipping excess fibers of claim 7, wherein the sensor further identifies the measured sections of the log or stem that are distally extending from the baseline diameter.

9. The VOR for chipping excess fibers of claim 7, wherein the sensor is located before the reducing portion.

10. The VOR for chipping excess fibers of claim 7, wherein the sensor is a 3D scanner.

11. The VOR for chipping excess fibers of claim 1, wherein the infeed portion is longitudinally aligning the log or stem with a central portion of the reducing portion.

12. The VOR for chipping excess fibers of claim 1, wherein a pair of the chipping tools are arranged opposite one another.

13. The VOR for chipping excess fibers of claim 12, wherein the pair of opposed chipping tools are radially movable about the longitudinal axis of the log or stem.

14. The VOR for chipping excess fibers of claim 1, wherein the infeed portion and outfeed portion each comprise a first pair of opposed centering rolls and the infeed portion and outfeed portion further comprise a second pair of opposed centering rolls perpendicularly positioned with the first pair of opposed centering rolls.

15. The VOR for chipping excess fibers of claim 1, wherein each of the chipping tools comprises opposed frustoconical chipping portions forming a recessed portion therebetween.

16. The VOR for chipping excess fibers of claim 1, wherein at least one of the chipping tools rotates about a rotation axis being at an angle ranging from 60 to 90 degrees with at least one other rotation axis of another chipping tool.

17. A method for chipping excess fibers on a log or stem periphery, the method comprising:

identifying a flared butt of the log or stem;

calculating a baseline diameter of the log or stem based on the identified flared butt;

linearly displacing a plurality of rotating chipping tools rotating about rotation axes being at an angle with at least one other chipping tool to a fixed position to form a substantially round passageway along a longitudinal axis of the log or stem prior to the rotating chipping tools receiving the log, the passageway having a diameter about equal to the calculated baseline diameter of the log or stem and being about perpendicular to the longitudinal axis and two of the plurality of rotating chipping tools are linearly displaced along the same displacement axis;

moving the log or stem into the formed passageway along the longitudinal log or stem axis to chip any peripheral sections in excess of the calculated baseline diameter of the log or stem.

18. The method of claim 17, the determination of the baseline diameter further comprising scanning the log or stem.

19. The method of claim 17, the baseline diameter being determined as being the diameter of the log or stem adjacent to the flared butt.

20. The method of claim 17, the method further comprising identifying the extremity at which the flared butt is found on the log or stem.

21. The method of claim 17, the substantially round passageway being formed with opposed frustoconical chipping heads having a recessed portion therebetween.

22. The VOR for chipping excess fibers of claim 1, wherein the circular processing passageway is formed prior to receiving the log.

* * * * *